US010041318B2

(12) United States Patent
Nguyen

(10) Patent No.: US 10,041,318 B2
(45) **Date of Patent: *Aug. 7, 2018**

(54) FULL BORE SYSTEM WITHOUT STOP SHOULDER

(71) Applicant: Cameron International Corporation, Houston, TX (US)

(72) Inventor: Dennis P. Nguyen, Pearland, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 742 days.

This patent is subject to a terminal disclaimer.

(21) Appl. No.: 14/453,357

(22) Filed: Aug. 6, 2014

(65) Prior Publication Data

US 2014/0345849 A1 Nov. 27, 2014

Related U.S. Application Data

(63) Continuation of application No. 13/124,688, filed as application No. PCT/US2009/066926 on Dec. 7, 2009, now Pat. No. 8,826,994.

(60) Provisional application No. 61/138,773, filed on Dec. 18, 2008.

(51) Int. Cl.

| | |
|---|---|
| ***E21B 23/01*** | (2006.01) |
| ***E21B 23/00*** | (2006.01) |
| ***E21B 33/038*** | (2006.01) |
| ***E21B 33/035*** | (2006.01) |
| ***E21B 33/04*** | (2006.01) |

(52) U.S. Cl.

CPC ..... *E21B 23/01* (2013.01); *E21B 23/00* (2013.01); *E21B 33/035* (2013.01); *E21B 33/038* (2013.01); *E21B 33/04* (2013.01)

(58) Field of Classification Search

CPC ..... E21B 23/01; E21B 33/04; E21B 23/00; E21B 33/035; E21B 33/038

See application file for complete search history.

(56) References Cited

U.S. PATENT DOCUMENTS

| | | | | |
|---|---|---|---|---|
| 4,474,236 | A | 10/1984 | Kellett | |
| 4,784,222 | A * | 11/1988 | Ford | E21B 33/04 166/115 |
| 6,227,300 | B1 | 5/2001 | Cunningham et al. | |
| 7,040,407 | B2 | 5/2006 | Jennings et al. | |
| 7,380,607 | B2 | 6/2008 | Thomas | |
| 7,445,046 | B2 * | 11/2008 | Borak, Jr. | E21B 33/04 166/313 |

(Continued)

OTHER PUBLICATIONS

PCT/US2009/066926 International Search Report and Written Opinion, dated May 24, 2010 (10 p.).

*Primary Examiner* — Yong-Suk Ro
(74) *Attorney, Agent, or Firm* — Chamberlain Hrdlicka

(57) ABSTRACT

A production assembly for controlling production from a well includes a wellhead and a tubing hanger assembly. The wellhead includes a bore formed through the wellhead with a first groove and a second groove each extending into the wellhead and axially spaced apart from each other. The tubing hanger assembly is installable in the wellhead and includes a load segment expandable into engagement with the first groove to support the tubing hanger assembly within the wellhead and a lock ring expandable into engagement with the second groove to secure the tubing hanger assembly within the wellhead.

21 Claims, 9 Drawing Sheets

(56) References Cited

U.S. PATENT DOCUMENTS

| | | | | |
|---|---|---|---|---|
| 8,826,994 | B2 * | 9/2014 | Nguyen | E21B 33/04 166/368 |
| 2001/0054507 | A1 * | 12/2001 | Bartlett | E21B 33/0355 166/368 |
| 2005/0274526 | A1 * | 12/2005 | Thomas | E21B 33/038 166/348 |
| 2005/0284640 | A1 * | 12/2005 | Borak, Jr. | E21B 33/04 166/369 |
| 2007/0007012 | A1 * | 1/2007 | Bartlett | B24B 37/04 166/344 |
| 2007/0204999 | A1 | 9/2007 | Cowie et al. | |
| 2014/0144650 | A1 * | 5/2014 | Yates | E21B 33/038 166/379 |

* cited by examiner

FULL BORE SYSTEM WITHOUT STOP SHOULDER

BACKGROUND

Conventionally, wells in oil and gas fields are built up by establishing a wellhead housing and, with a drilling blow out preventer (BOP) adapter valve installed, drilling down to produce the borehole while successively installing concentric casing strings. The casing strings are cemented at their lower ends and sealed with mechanical seal assemblies at their upper ends. In order to convert the cased well for production, a production tubing string is run in through the BOP and a tubing hanger at its upper end is typically landed in the wellhead. Thereafter the drilling BOP is removed and replaced by a Christmas tree having one or more production bores containing valves and extending vertically to respective lateral production fluid outlet ports in the wall of the tree.

The tubing hanger is installed by a hanger running tool and the tool lowers the tubing hanger down the production bore until it lands on top of a stop shoulder. The stop shoulder is created with a decreased inner diameter portion of the housing in which the hanger is landed, which provides a permanent means to stop the lowering of the tubing hanger.

During subsequent operations, the difference in diameter of inner bore created by the permanent stop shoulder may present an inner diameter that can impede the progress of elements that are intended to be lowered past the stop shoulder. In this case, the utilization of the stop shoulder could present and inner diameter less than the inner diameter that would allow an element such as a workover tool to progress downward through the bore. If no stop shoulder were present, such and impedance would not occur and the maximum inner diameter of the production bore would be available to the operator. In addition, the standard amount of housing required between the production bore and a wellhead casing increases proportionally with the inner diameter of the production bore. If no stop shoulder is present, the amount of material can be decreased, per required standards. The absence of a stop shoulder would create "full" production bore, where the inner diameter of the production bore is limited only by the inner wall of the production bore itself.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
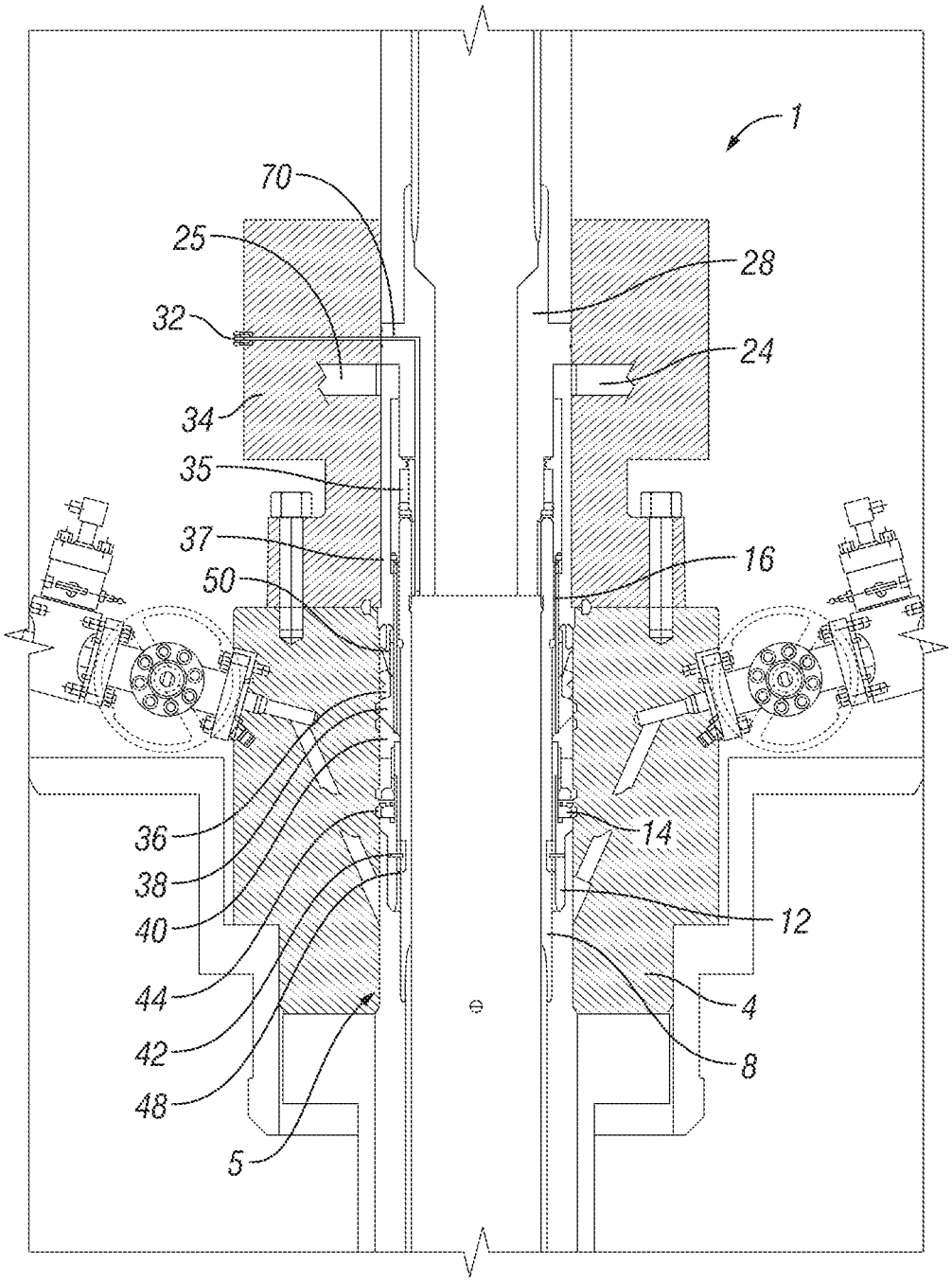
FIG. 1 is a sectional view of a full bore production system showing a production full-bore support casing.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1 there is shown a standard full bore production system 1 including a wellhead 4, a BOP adapter 34, and a hanger running tool 28. The wellhead 4 is landed on top of a conductor casing 3. The wellhead 4 controls and monitors flow, temperature, and pressure of the production fluid or gas via a plurality of valves and tubing (not shown) inside of the full bore production system 1. The BOP adapter 34 is landed atop the wellhead 4 and bolted to wellhead 4 using bolts as shown or any other suitable attachment means.

A tubing hanger system 5 is lowered through the top of the BOP adapter 34 and landed in position inside the wellhead 4 via a hanger running tool 28. The tubing hanger system 5 includes a hanger body 8 supporting a production tubing and a load shoulder 12 that includes a load segment 14. The load shoulder 12 is designed to receive loading that may be transferred during construction and operation of the full bore production system 1. The load shoulder 12 also includes an upper load sleeve 38 and a lower load sleeve 40. The load sleeves 38, 40 move independently of each other and transfer applied loading via free-fall movement of tubing hanger body 8 and a stud force pin 16 respectively. Further, hanger system 5 includes an upper lock ring 36 that is manipulated between a locked and an unlocked position by the movement of a wedge 50.

Loading transferred to the tubing hanger system 5 components in the full bore production system 1 may originate from a hanger running tool 28. The hanger running tool 28 includes a sealed port 70 for fluid communication with the BOP adapter 34 and an outer sleeve 37. The hanger running tool 28 is "run" by being lowered through the top of the BOP adapter 34 and temporarily landed inside of BOP adapter 34 using load pins 24, 25 that are manipulated between extended and withdrawn positions per operator discretion as discussed below. Although only two load pins 24, 25 are shown, it should be appreciated that as many load pins as desired may be used. The hanger running tool 28, in use, applies pressure force to the full bore production system 1 via a chamber 35 and hydraulic fluid communicated through the pressure port 32 in the BOP adapter 34.

In use, a downhole completion is initiated by drilling and completing an oil or gas production well in such a manner that the well can allow proper flow during the period in which the reservoir operates. The full bore production system 1 may be used for completing the well with the tubing hanger system 5 installed to allow communication and control of downhole functions and as a sealing mechanism for the production components that are utilized in the operation of the well.

Figure 1A:
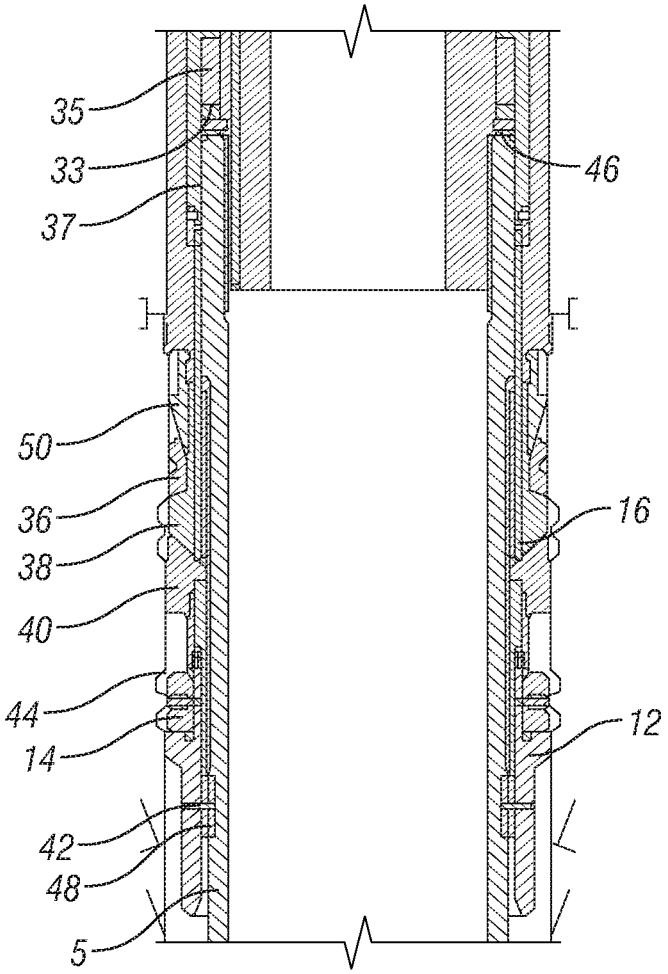
FIG. 1A shows a detailed sectional view showing a close up of some of the full bore production system components.

The tubing hanger system 5 is positioned and installed by utilizing the hanger running tool 28 to insure proper placement and to keep the tubing and control lines from becoming entangled in the system. The hanger system 5 includes the upper lock ring mechanism 36, the upper and lower load sleeves 38, 40, the outer loading sleeve 37, a stud force pin 16, and the load segment 14 mechanism. These elements provide the means for running, setting, locking, and preloading the load segment 14 mechanism without requiring the use of a permanent stop shoulder in the wellhead 4. This method will also limit the possibility of leakage in the system tubing due to the fact that the load segment mechanism can be run with the tubing hanger system 5 in a single approach—thus limiting the opportunities for potential leakage upon its removal. It should be noted that as shown in FIGS. 1 and 1A, the full bore production system 1 is in the running position configuration.

Figure 2:
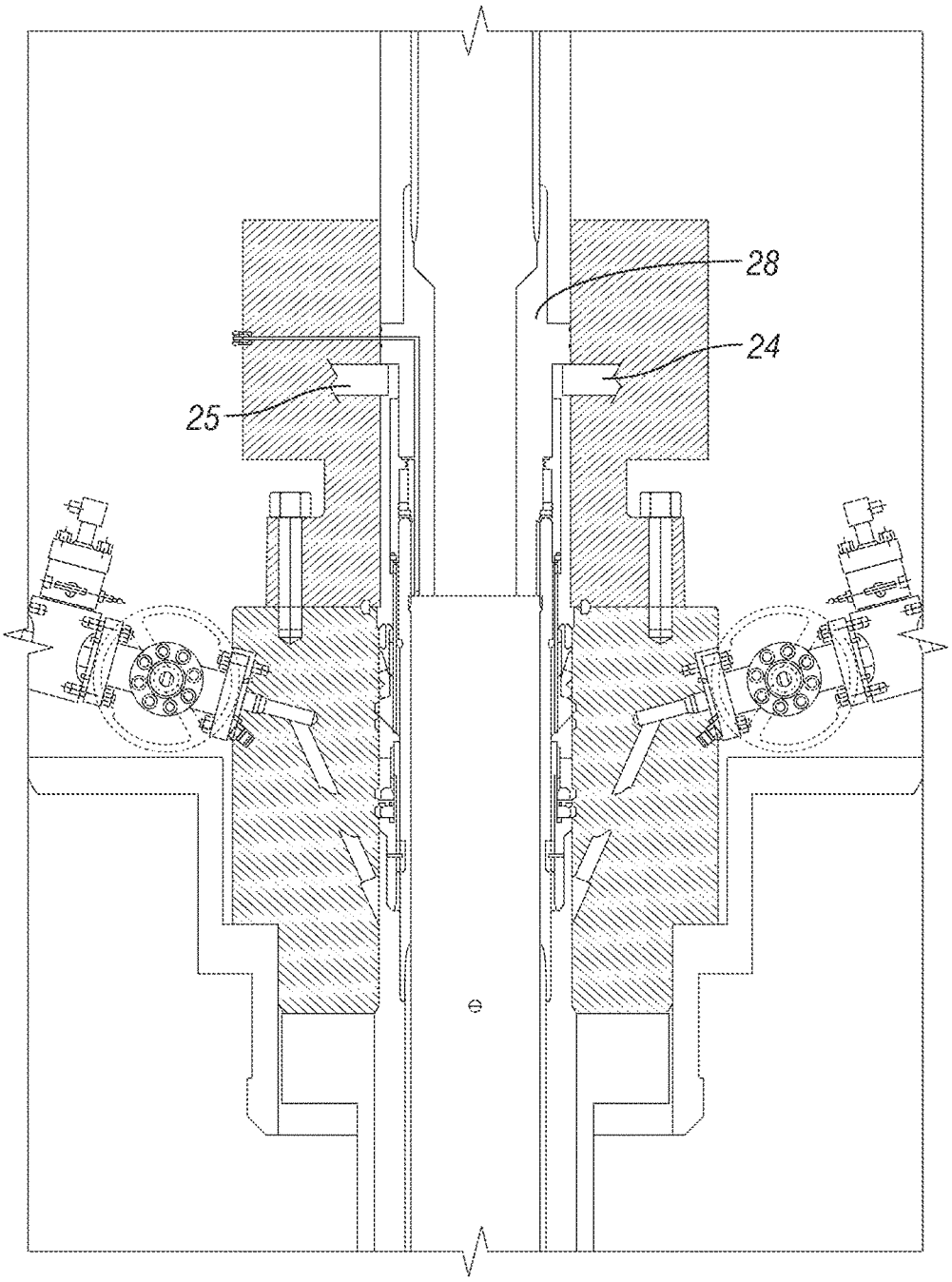
FIGS. 2-8 include sectional views of the full bore production system during installation.

FIGS. 2-8 show further installation of the hanger system 5. Referring to FIG. 2, at least the load pins 24, 25 are set into the extended position in the direction of the hanger running tool 28. (It should be noted that this embodiment could contain more than two load pins.) This movement may be actuated from variant sources, however, the conventional source is through manual operation. The purpose of moving the load pins 24, 25, is to locate and temporarily support the hanger system 5 and to provide verification of the elevation of the casing. This setting is known as the run-in position for the full bore production system 1.

Figure 3:
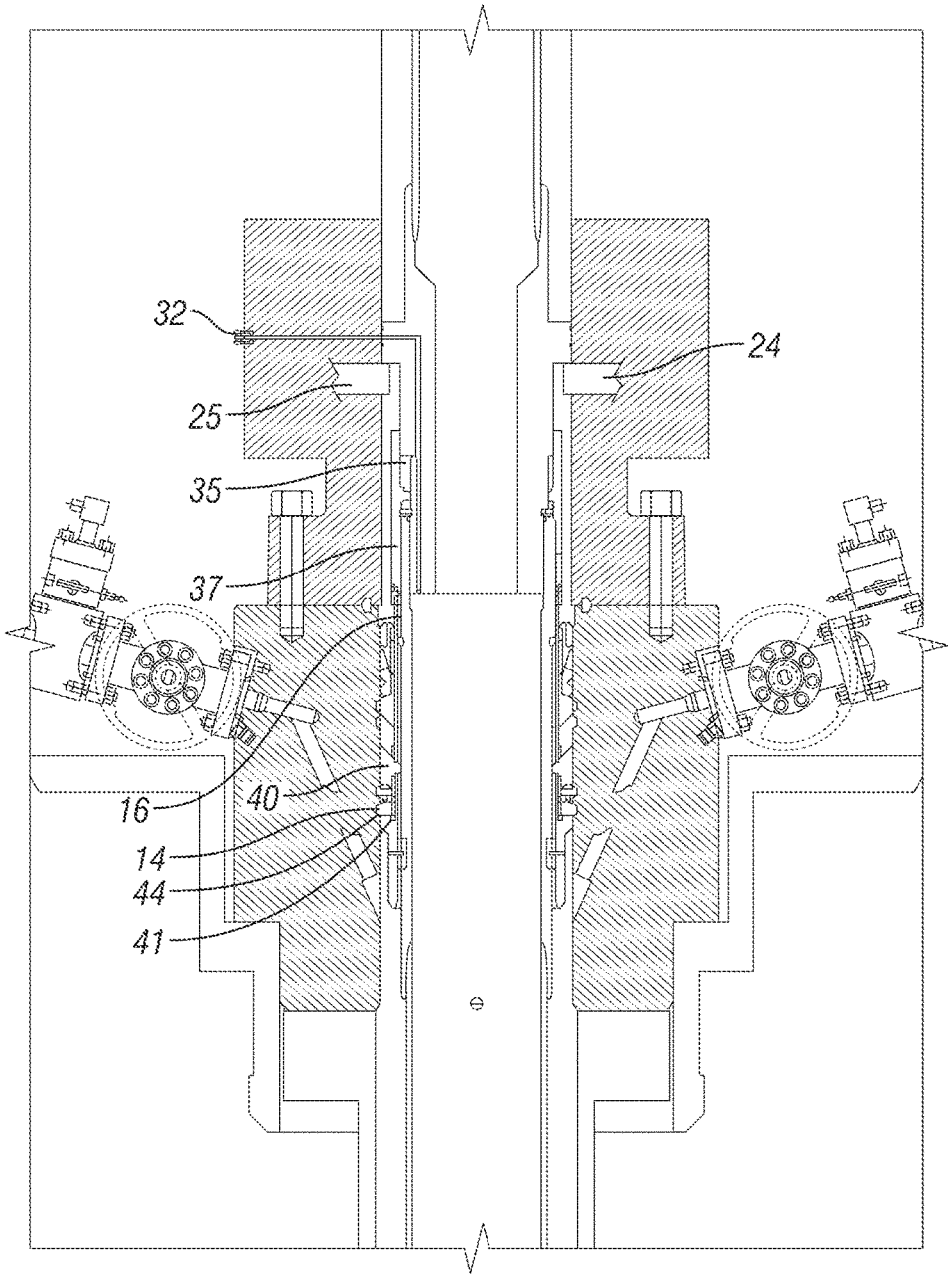

Referring to FIG. 3, hydraulic fluid pressure is applied through the pressure port 32 orifice to set and lock the load shoulder 12. Pressure is applied at pressure port 32 and this pressure load is introduced into the chamber 35 above an annular collar on the inside of the outer sleeve 37, effecting a hydraulic piston. The increased pressure in the chamber 35 is transferred to the outer sleeve 37 through the collar, shifting the sleeve 37 downward and applying pressure force to the stud force pin 16. This pressure loading of the stud force pin 16 transfers to the lower load sleeve 40, causing it and a wedge 41 to move downward. Movement of the wedge 41 relative to the load segment 14 causes the load segment 14 to move in a radially outward motion towards a groove 44 machined into the inner bore of the wellhead 4 until the load segment 14 is set in the groove 44. Once set, the load segment 14 may receive and support subsequent loading.

Figure 4:
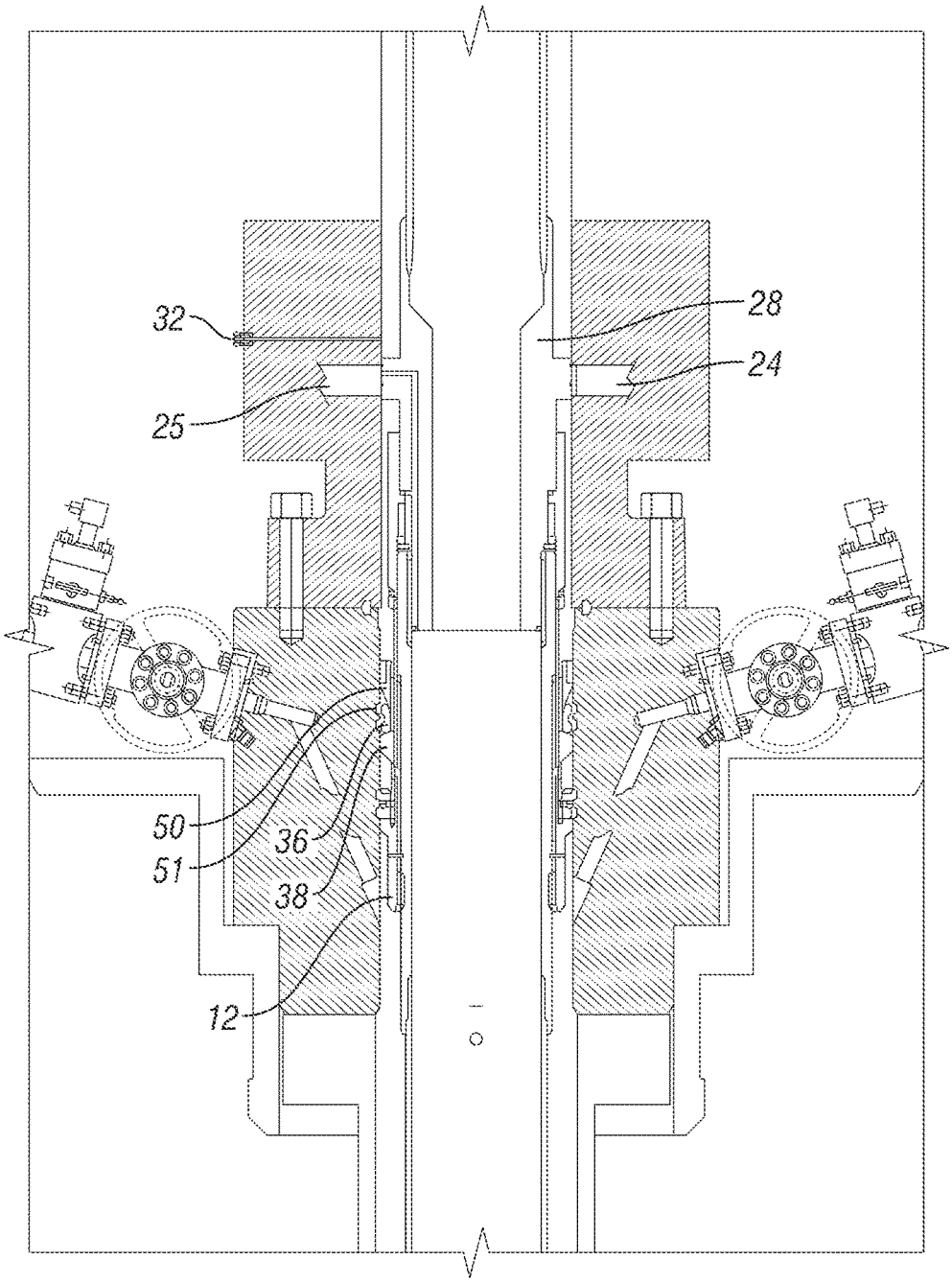

Referring to FIG. 4, with the load segment 14 extended, the hanger body 8 is supportable using the engagement of the load segment 14 with the groove 44 as a load shoulder. Transfer of the load to the load segment 14 is accomplished by retracting the load pins 24, 25 while holding the hanger body 8 using the running tool 28, and then slowly releasing the hanger body 8. With enough downward force, the hanger body 8 shears a force shear pin 42 located inside of a shear pin housing 48, allowing the hanger body 8 to continue to move in a downward direction until the hanger body 8 is supported by the load shoulder 12.

Figure 5:
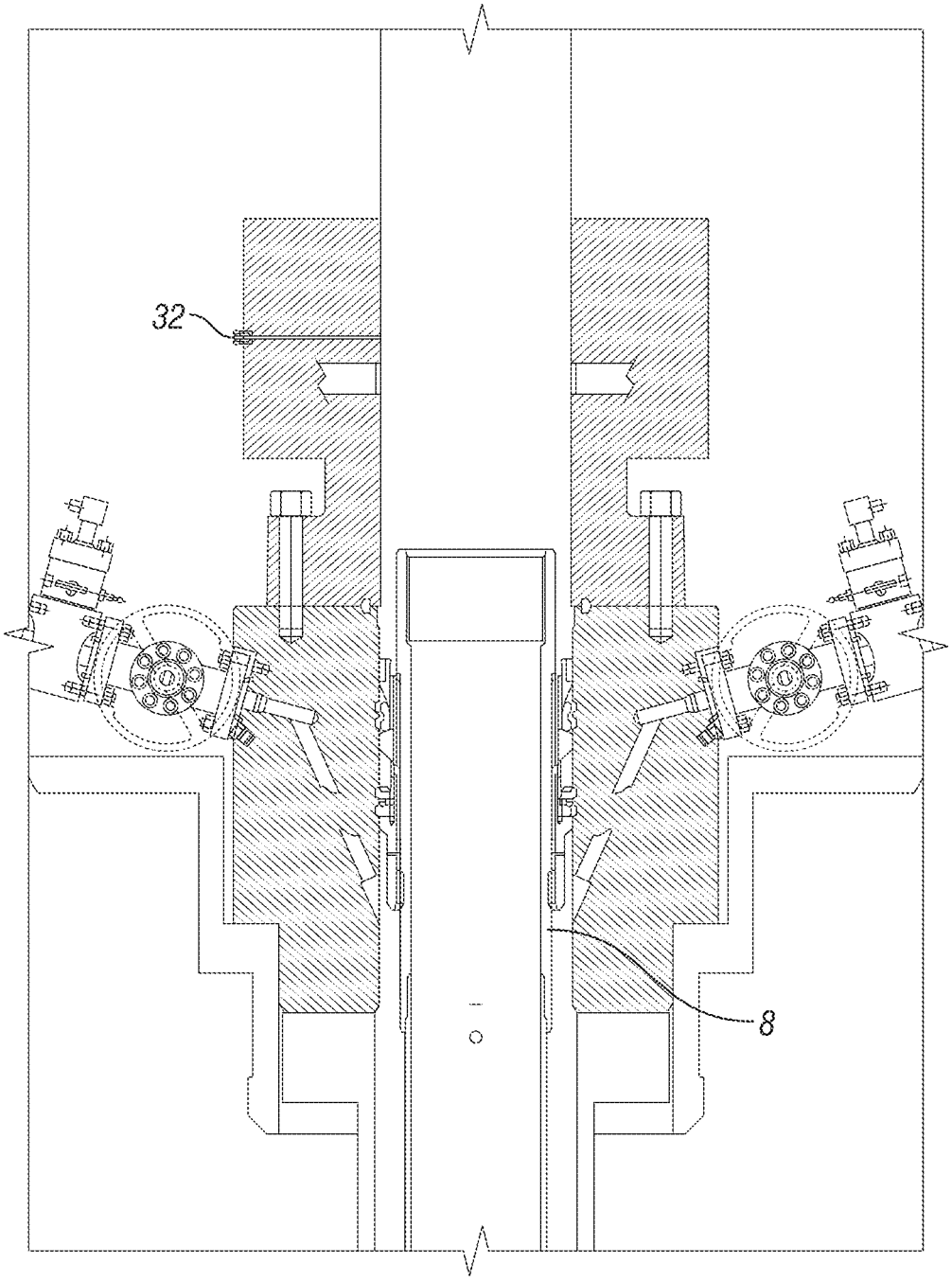

Referring to FIG. 5, once the hanger body 8 is landed, the pressure supplied to the system through pressure port 32 is terminated and the running tool 28 is removed.

Figure 6:
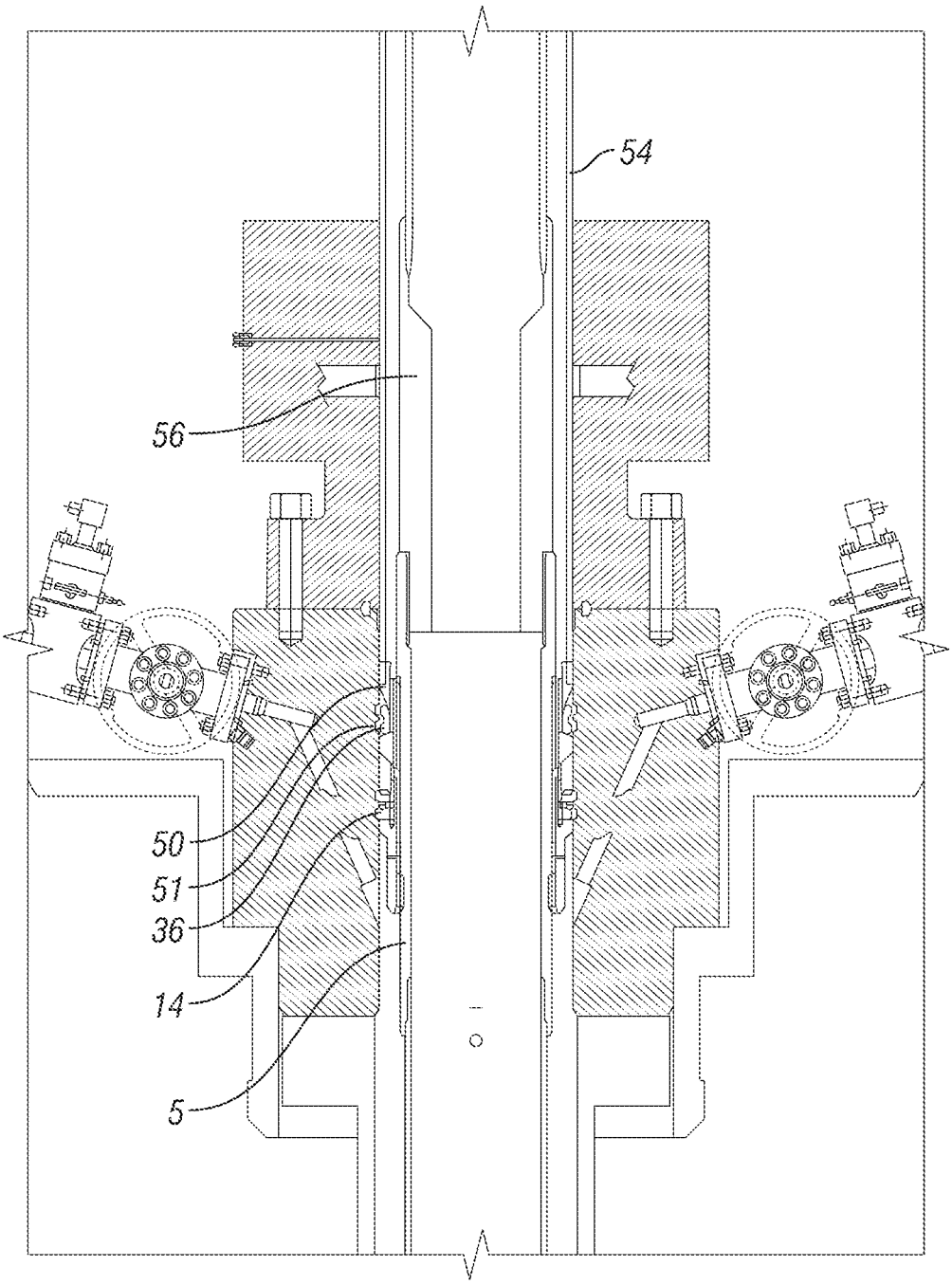

Referring to FIG. 6, an overshot tool 54 and an overpull tool 56 are positioned in the location previously occupied by hanger running tool 28. It should be appreciated that in the case that the tubing hanger body 8 is adjustable, overpull tool 56 may be used to position the adjustable hanger per the operator's specification and then to subsequently lock the hanger in place.

Figure 7:
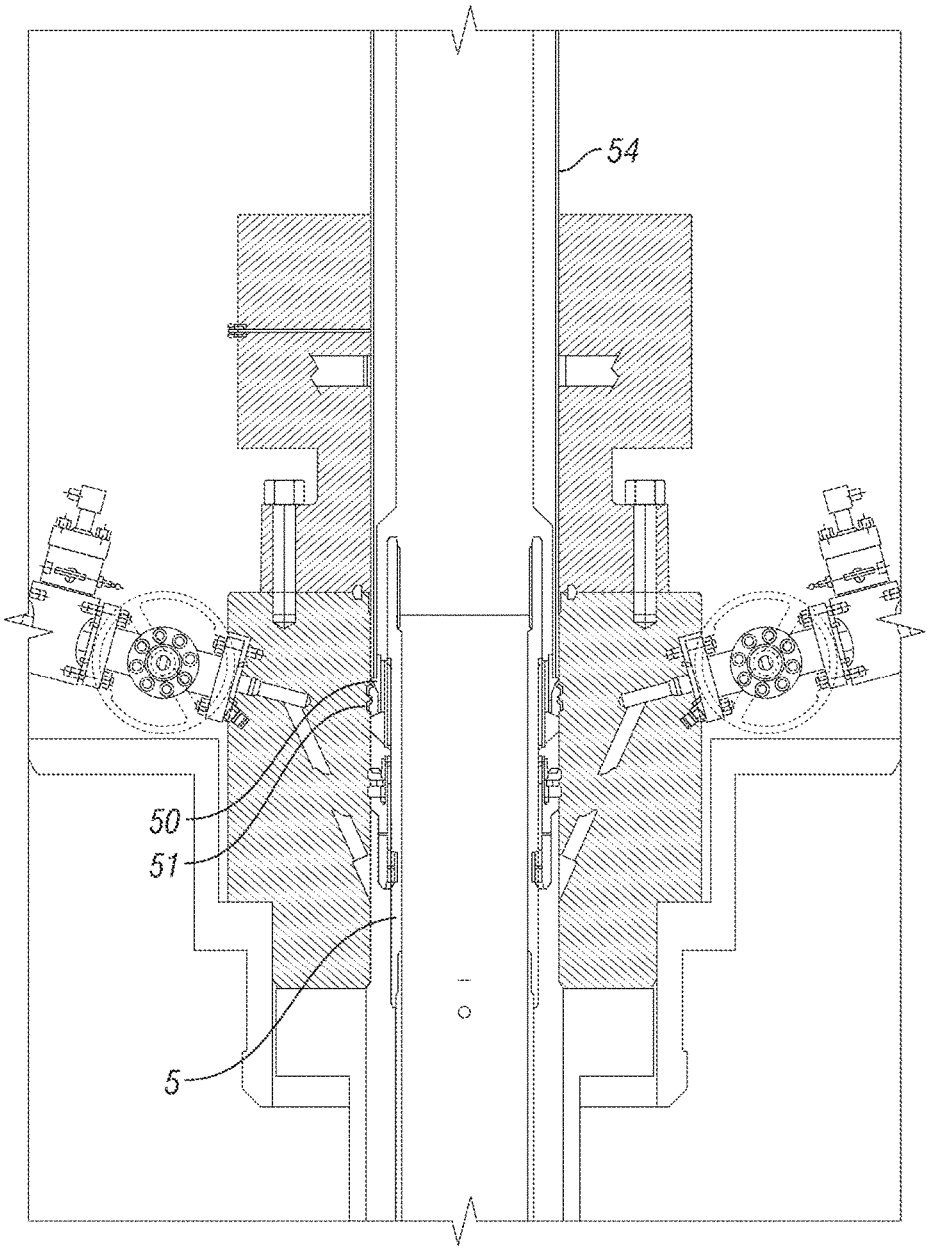
Figure 8:
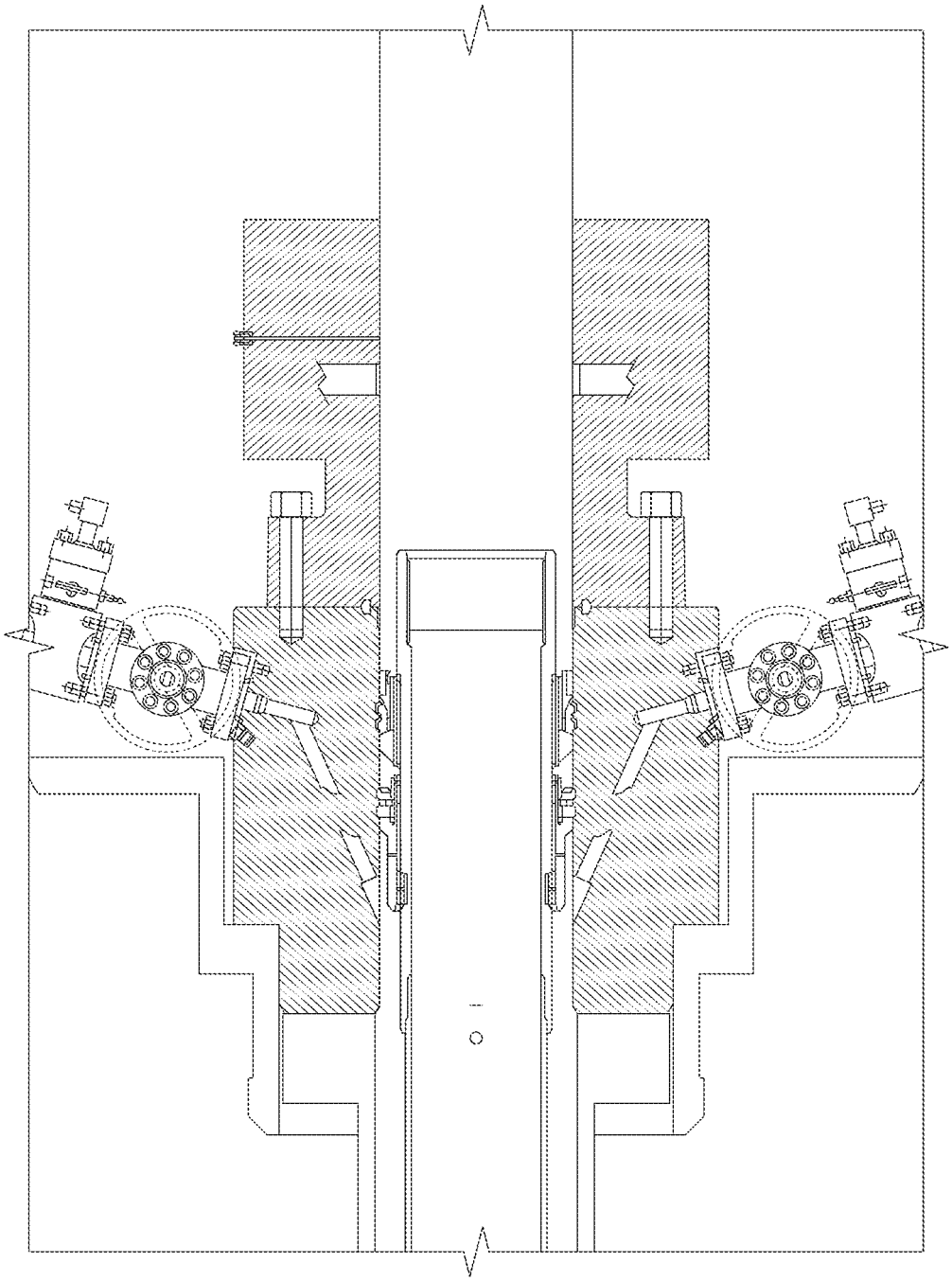

Referring to FIG. 7, once the hanger body 8 is positioned, the overshot tool 54 may be rotated to apply torque to the wedge 50, which is threaded to the outside of the upper load sleeve 38. Relative rotation of the wedge 50 to the upper load sleeve 38 drives the wedge 50 downward, applying an outward force to upper lock ring 36 and expanding the lock ring 36 into a groove 51. The movement of upper lock ring 36 towards the groove 51 allows for movement of the adjustable tubing hanger body 8 per the user's discretion. With the wedge 50 moved downward and the upper locking ring 36 engaged with the groove 51, the hanger body 8 is considered locked in position. The overshoot tool 54 may now be removed from the system as shown in FIG. 8.

Subsequent to installing the full bore system 1, operations may need to be performed on the well that include removal of the hanger system 5 and the supported production tubing. Removal of the hanger system 5, including the load shoulder 12 may be performed by unlocking and unsetting the hanger system 5 and then removing the system 5 from the wellhead 4. When removed, the wellhead 4 offers full bore access for running in tools or elements downhole for performing well operations such as workover procedures. The wellhead 4 thus does not limit the size of elements run into the well to a reduced inner diameter of a permanent load shoulder in the wellhead 4.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A production assembly for controlling production from a well, the assembly comprising:

a wellhead including a bore formed through the wellhead with a first groove and a second groove each extending into the wellhead and axially spaced apart from each other; and a tubing hanger assembly installable in the wellhead and comprising:

a load segment expandable into engagement with the first groove to support the tubing hanger assembly within the wellhead; and a lock ring expandable into engagement with the second groove to secure the tubing hanger assembly within the wellhead.

2. The assembly of claim 1, wherein the wellhead does not include a support shoulder extending into the interior of the bore.

3. The assembly of claim 1, wherein the tubing hanger assembly further comprises:

a load shoulder;

a tubing hanger supportable by the load shoulder; and wherein the load segment is movably connected to the load shoulder.

4. The assembly of claim 3, wherein the tubing hanger is positionable by a tubing hanger running tool onto the load shoulder to transfer support of the tubing hanger to the load shoulder.

5. The assembly of claim 1, wherein the load segment is configured to expand into engagement with the first groove before the lock ring expands into engagement with the second groove.

6. The assembly of claim 1, wherein the load segment is expandable into engagement with the first groove independently of the lock ring expandable into engagement with the second groove.

7. The assembly of claim 1, wherein the tubing hanger assembly further comprises a first wedge and a second wedge, the first wedge being configured to be actuated by hydraulic fluid pressure to be moved within the bore of the wellhead to expand the load segment into engagement with the first groove, and the second wedge being configured to be actuated by mechanical force to move within the bore of the wellhead to expand the lock ring into engagement with the second groove.

8. The assembly of claim 1, further comprising an adapter mountable on the wellhead to selectively support the tubing hanger assembly when not engaged with the wellhead.

9. The assembly of claim 8, wherein:

the adapter comprising a load pin moveable between an extended position for supporting the tubing hanger assembly and a withdrawn position; and a tubing hanger running tool configured to run the tubing hanger assembly into the wellhead and land on the load pin in the extended position to support the tubing hanger assembly.

10. The assembly of claim 9, wherein:

the adapter comprises a first hydraulic port;

the tubing hanger running tool comprises a second hydraulic port, the first and second hydraulic ports being alignable with each other for hydraulic fluid to be communicated through the first and second hydraulic ports to actuate the expansion of the load segment into engagement with the bore of the wellhead.

11. The assembly of claim 1, further comprising an overshot tool engageable with the tubing hanger assembly to expand the lock ring into engagement with the second groove.

12. The assembly of claim 11, wherein:

the adapter comprising a load pin moveable between an extended position for supporting the tubing hanger assembly and a withdrawn position; and a tubing hanger running tool configured to run the tubing hanger assembly into the wellhead and land on the load pin in the extended position to support the tubing hanger assembly.

13. The assembly of claim 12, wherein:

the adapter comprises a first hydraulic port;

the tubing hanger running tool comprises a second hydraulic port, the first and second hydraulic ports being alignable with each other for hydraulic fluid to be communicated through the first and second hydraulic ports to actuate the expansion of the load segment into engagement with the bore of the wellhead.

14. A production assembly for controlling production from a well, the assembly comprising:

a wellhead including a bore formed through the wellhead with a first groove and a second groove formed within the bore, and the second groove is axially spaced apart from the first groove;

a tubing hanger assembly installable in the wellhead and comprising:

a load segment expandable into engagement with the first groove; and a lock ring expandable into engagement with the second groove to secure the tubing hanger assembly within the wellhead; and an adapter mountable on the wellhead to selectively support the tubing hanger assembly within the wellhead.

15. The assembly of claim 14, wherein the load segment is configured to expand into engagement with the first groove before the lock ring expands into engagement with the second groove.

16. The assembly of claim 14, wherein the load segment is expandable into engagement with the first groove independently of the lock ring expandable into engagement with the second groove.

17. The assembly of claim 14, wherein the tubing hanger assembly further comprises a first wedge and a second wedge, the first wedge being configured to be actuated by hydraulic fluid pressure to be moved within the bore of the wellhead to expand the load segment into engagement with the first groove, and the second wedge being configured to be actuated by mechanical force to move within the bore of the wellhead to expand the lock ring into engagement with the second groove.

18. The assembly of claim 14, further comprising an overshot tool engageable with the tubing hanger assembly to expand the lock ring into engagement with the second groove.

19. The assembly of claim 14, wherein the wellhead does not include a support shoulder extending into the interior of the bore.

20. The assembly of claim 14, wherein the tubing hanger assembly further comprises:

a load shoulder;

a tubing hanger supportable by the load shoulder; and wherein the load segment is movably connected to the load shoulder.

21. The assembly of claim 20, wherein the tubing hanger is positionable by a tubing hanger running tool onto the load shoulder to transfer support of the tubing hanger to the load shoulder.

* * * * *